US011193725B2

(12) United States Patent
Lee et al.

(10) Patent No.: US 11,193,725 B2
(45) **Date of Patent: *Dec. 7, 2021**

(54) FIREARM MAGAZINE EXTENSION WITH LOCKING PLATE AND POCKET CLIP

(71) Applicant: Strike Industries, Inc., Santa Ana, CA (US)

(72) Inventors: Shanyao Lee, Santa Ana, CA (US); Alvin Nam Oh, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/929,488

(22) Filed: Jul. 15, 2020

(65) Prior Publication Data

US 2020/0348095 A1 Nov. 5, 2020

Related U.S. Application Data

(63) Continuation-in-part of application No. 16/812,263, filed on Mar. 6, 2020.

(60) Provisional application No. 62/815,939, filed on Mar. 8, 2019.

(51) Int. Cl.
*F42B 39/02* (2006.01)
*F41A 9/71* (2006.01)
*F41A 9/63* (2006.01)

(52) U.S. Cl.
CPC ..... *F41A 9/63* (2013.01); *F41A 9/71* (2013.01); *F42B 39/02* (2013.01)

(58) Field of Classification Search
CPC ..... F41A 9/65; F41A 9/71
See application file for complete search history.

(56) References Cited

U.S. PATENT DOCUMENTS 2,320,450 A * 6/1943 Valenzuela ..... F41C 33/008 42/106
5,526,600 A * 6/1996 Chesnut ..... F41A 9/65 42/50
5,584,136 A * 12/1996 Boland ..... F41A 9/71 42/50
5,666,752 A * 9/1997 Grams ..... F41A 9/71 42/49.02
7,509,767 B2 * 3/2009 Bolen ..... F41A 9/61 42/49.01
8,671,606 B2 * 3/2014 Plataniotis ..... F41A 9/65 42/6
9,677,847 B2 * 6/2017 Finsand ..... F41C 33/008
2002/0029506 A1 * 3/2002 Wollmann ..... F41A 9/65 42/50
2005/0011097 A1 * 1/2005 Freed ..... F41A 9/65 42/49.02

(Continued)

FOREIGN PATENT DOCUMENTS

CA 2930014 A1 * 12/2016 ..... F41A 9/66

*Primary Examiner* — Gabriel J. Klein
(74) *Attorney, Agent, or Firm* — Han IP PLLC; Andy M. Han

(57) ABSTRACT

A device implementable on a firearm includes a magazine extension housing, a pocket clip and a securing device. The magazine extension housing is attachable to a bottom opening of a magazine well of a magazine that is implementable on the firearm. The securing device is configured to secure the pocket clip to the magazine extension housing.

8 Claims, 5 Drawing Sheets

(56) References Cited

U.S. PATENT DOCUMENTS

| | | | | |
|---|---|---|---|---|
| 2011/0107645 | A1* | 5/2011 | Faifer | F41A 9/63<br>42/90 |
| 2012/0091173 | A1* | 4/2012 | Crye | F42B 39/02<br>224/196 |
| 2017/0184359 | A1* | 6/2017 | Porat | F41C 33/006 |
| 2017/0321979 | A1* | 11/2017 | Szczepkowski | F41A 9/71 |
| 2018/0031342 | A1* | 2/2018 | Faifer | F41A 9/70 |
| 2018/0051948 | A1* | 2/2018 | Corso | F41A 9/65 |
| 2018/0347929 | A1* | 12/2018 | Hsu | F41A 9/71 |
| 2019/0285374 | A1* | 9/2019 | Bowler | F41A 11/00 |
| 2020/0064092 | A1* | 2/2020 | Pini | F41A 9/65 |
| 2020/0103089 | A1* | 4/2020 | Becker | B60Q 1/0005 |
| 2020/0208929 | A1* | 7/2020 | Corso | F41A 9/71 |

* cited by examiner

FIREARM MAGAZINE EXTENSION WITH LOCKING PLATE AND POCKET CLIP

CROSS REFERENCE TO RELATED PATENT APPLICATION(S)

The present disclosure is a continuation-in-part (CIP) of U.S. patent application Ser. No. 16/812,263, filed 6 Mar. 2020, which claims the priority benefit of U.S. Provisional Patent Application No. 62/815,939, filed 8 Mar. 2019. Contents of aforementioned applications are herein incorporated by reference in their entirety.

TECHNICAL FIELD

The present disclosure is generally related to firearms and, more particularly, to a firearm magazine extension with a steel locking plate that also functions as a pocket clip.

BACKGROUND

Unless otherwise indicated herein, approaches described in this section are not prior art to the claims listed below and are not admitted as prior art by inclusion in this section.

In the context of firearms, a detachable magazine is an ammunition storage and feeding mechanism or device that can be attached to a firearm. In operation, when the magazine is loaded with ammunition cartridges and attached to the firearm, an internal spring of the magazine exerts a force on a spring follower, which in turn pushes one or more rounds of the ammunition cartridges in the magazine well toward an action chamber of the firearm, thereby assisting in loading the rounds into the action chamber of the firearm. Certain magazines are customizable. One way of customizing a magazine is to extend the capacity of the magazine by installing a magazine extension at the bottom of the magazine body (magazine well). However, the reliability of some existing designs of magazine extensions is less than desirable.

Moreover, when a user desires to carry an extra magazine while concealed carrying, with current available accessories on the market, the user would typically use a magazine holder or magazine holster in which the extra magazine can be held. However, as the magazine holder/holster is discrete and separate from any magazine, the user would need to remember to place the extra magazine in the magazine holder/holster.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to provide a magazine extension with a steel locking plate that improves the security and reliability of the magazine extension. Another objective of the present disclosure is to provide a magazine extension with a pocket clip so that usage of an external magazine holder or holster for concealed carrying an extra magazine can be avoided.

In one aspect, a device implementable on a firearm (e.g., a pistol, rifle, carbine or shotgun) may include a magazine extension housing, a pocket clip and a securing device. The magazine extension housing may be attachable to a bottom opening of a magazine body (magazine well) of a magazine that is implementable on the firearm. The securing device may be configured to secure the pocket clip to the magazine extension housing.

In another aspect, a device implementable on a firearm may include a magazine extension housing, a pocket clip, a screw and a locking plate. The magazine extension housing may be attachable to a bottom opening of a magazine well of a magazine that is implementable on the firearm. The screw may be configured to secure the pocket clip to the magazine extension housing. The locking plate may be receivable in a portion of the magazine extension housing such that the locking plate is configured to lock the magazine extension housing to the magazine well when the magazine extension housing is attached to the magazine well of the magazine. Moreover, the magazine extension housing may be configured with a threaded through hole through which the screw is inserted to lock the pocket clip and the locking plate in place.

It is noteworthy that, although description provided herein may be in the context of certain configurations such as a magazine used in pistols, the proposed concepts, schemes and any variation(s)/derivative(s) thereof may be implemented in, for and by other configurations and designs, such as magazines used in rifles, carbines and shotguns. Thus, the scope of the present disclosure is not limited to the examples described herein.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Figure 1:
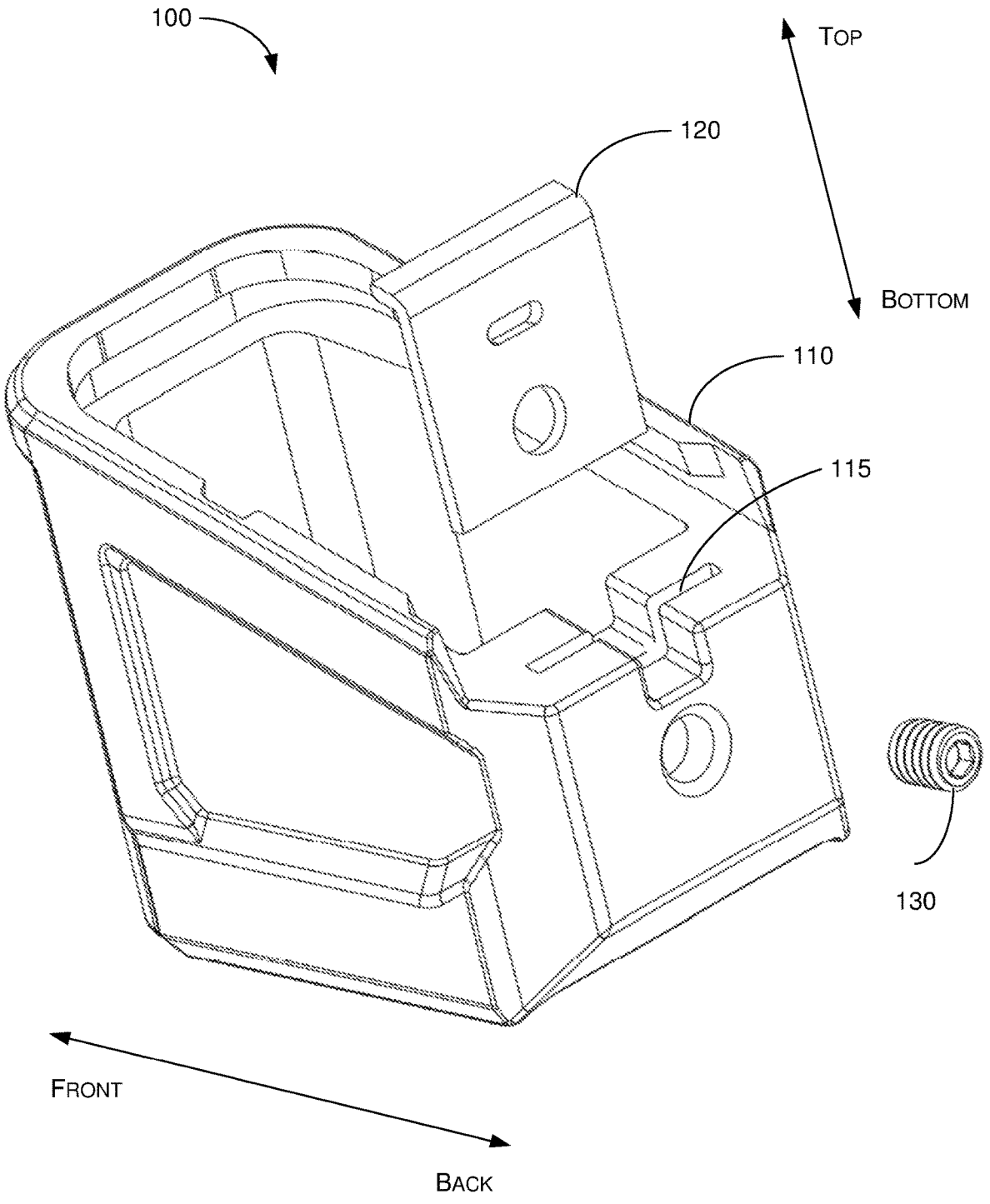
FIG. 1 is a diagram of a first step in assembling components of a firearm magazine extension in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

When a firearm magazine loaded with rounds of ammunition cartridges is dropped on a hard surface such as a concrete floor, one or more of the rounds of ammunition cartridges could possibly pop out of a base plate of the magazine. This is especially an issue for a magazine with a magazine extension installed thereon. That is, during impact, the magazine extension can slide out backward or even pop out upward. In one existing design of magazine extensions, a metal pin is used to keep the magazine extension from sliding out. However, the metal pin is not effective in keeping the magazine extension from popping out upward (e.g., toward the body/receiver of the firearm).

Illustrative Implementations

Figure 2:
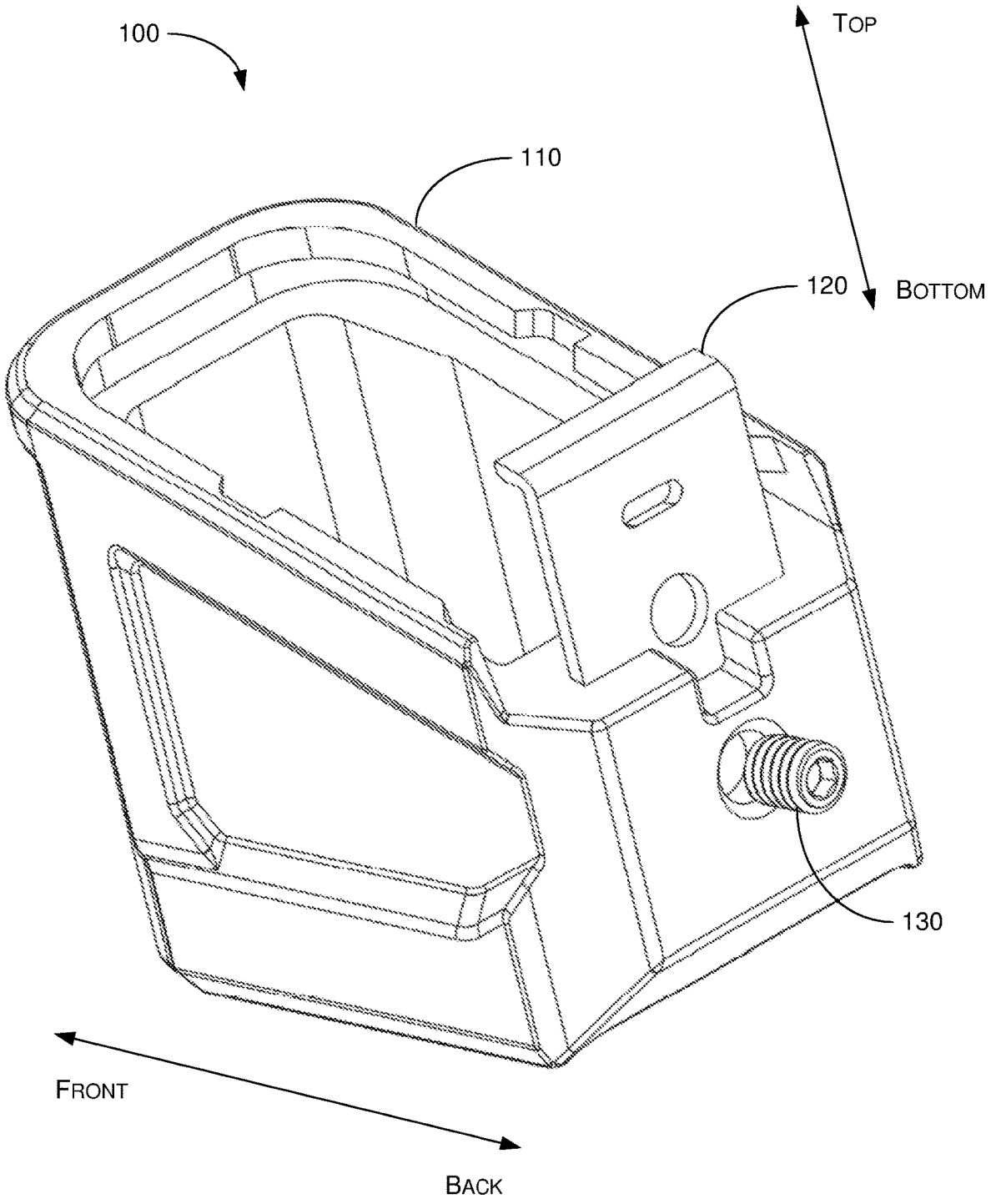
FIG. 2 is a diagram of a second step in assembling components of a firearm magazine extension in accordance with an implementation of the present disclosure.
Figure 3:
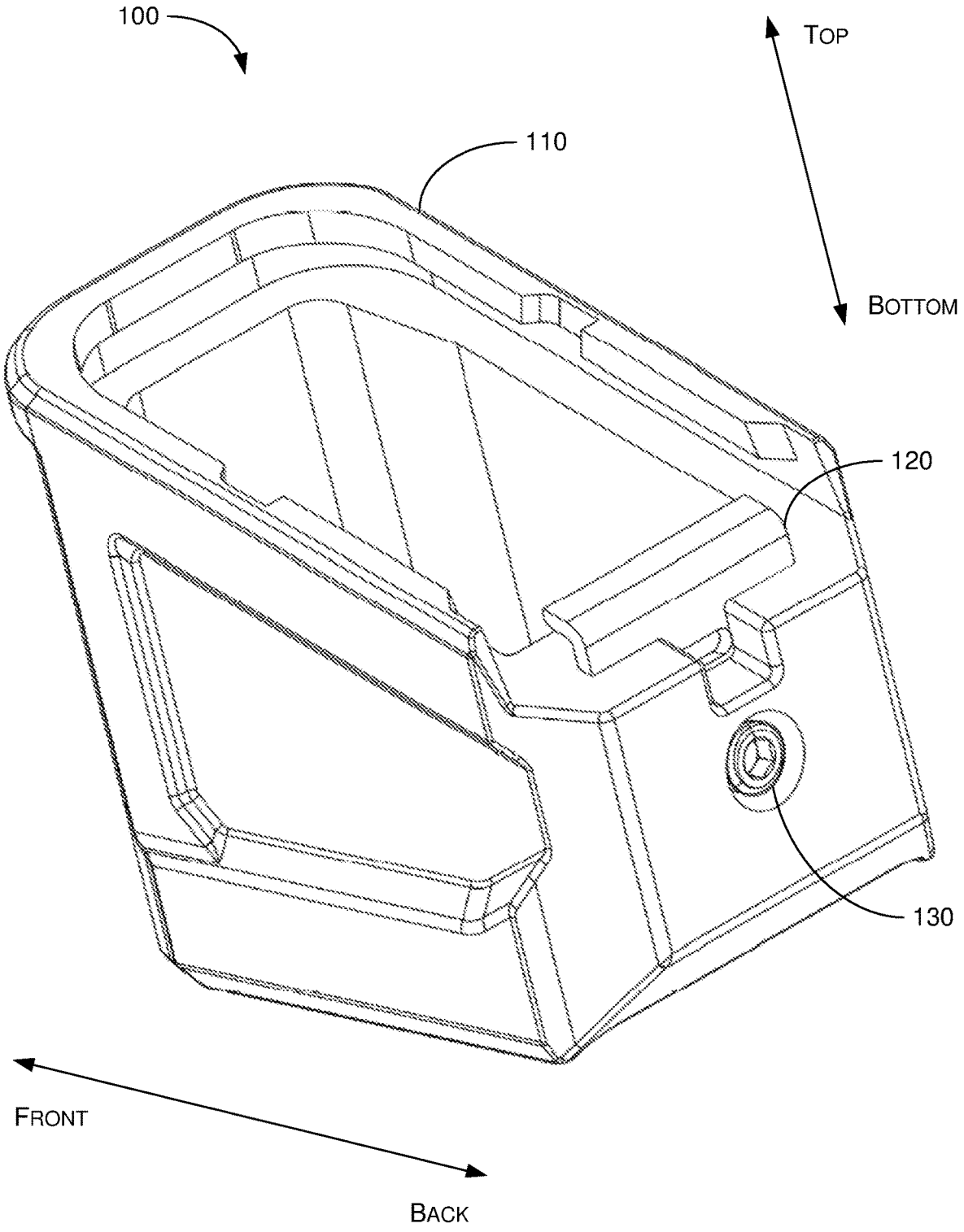
FIG. 3 is a diagram of a third step in assembling components of a firearm magazine extension in accordance with an implementation of the present disclosure.

FIG. 1~FIG. 3 illustrate sequential steps in assembling components of a firearm magazine extension 100 in accordance with an implementation of the present disclosure. Referring to FIG. 1~FIG. 3, magazine extension 100 in accordance with the present disclosure may include a magazine extension housing 110, a metal locking plate 120 and one or more set screws 130 (although a quantity of one is shown in FIG. 1~FIG. 3).

Metal locking plate 120, which may be made of steel, alloy or any suitable metallic material, provides additional security and reliability in keeping the magazine extension from coming apart from the magazine during impact (e.g., when falling on the ground). A first distal end (e.g., bottom end) of metal locking plate 120 may fit in and be received in a slot 115 in magazine extension housing 110. A second distal end (e.g., top end) opposite the first distal end of metal locking plate 120, which may be curved, may hook onto a back sidewall of the magazine body (magazine well) of the magazine (not shown). The one or more set screws 130 may be inserted from the back side of the magazine extension through one or more threaded through holes to lock metal locking plate 120 in place. In the example shown in FIG. 1~FIG. 3, magazine extension housing 110 has one threaded through hole and metal locking plate 120 is secured to magazine extension housing 110 by one set screw 130.

The uniqueness of metal locking plate 120 is the curved upper edge forming a hook which presses down onto the back sidewall of the magazine well when metal locking plate 120 is locked in place in magazine extension housing 110 by the one or more set screws 130. While existing magazine extensions on the market only keep the magazine from sliding out, the hook on the second distal end of metal locking plate 120 additionally provides locking function by holding the magazine down.

Figure 4:
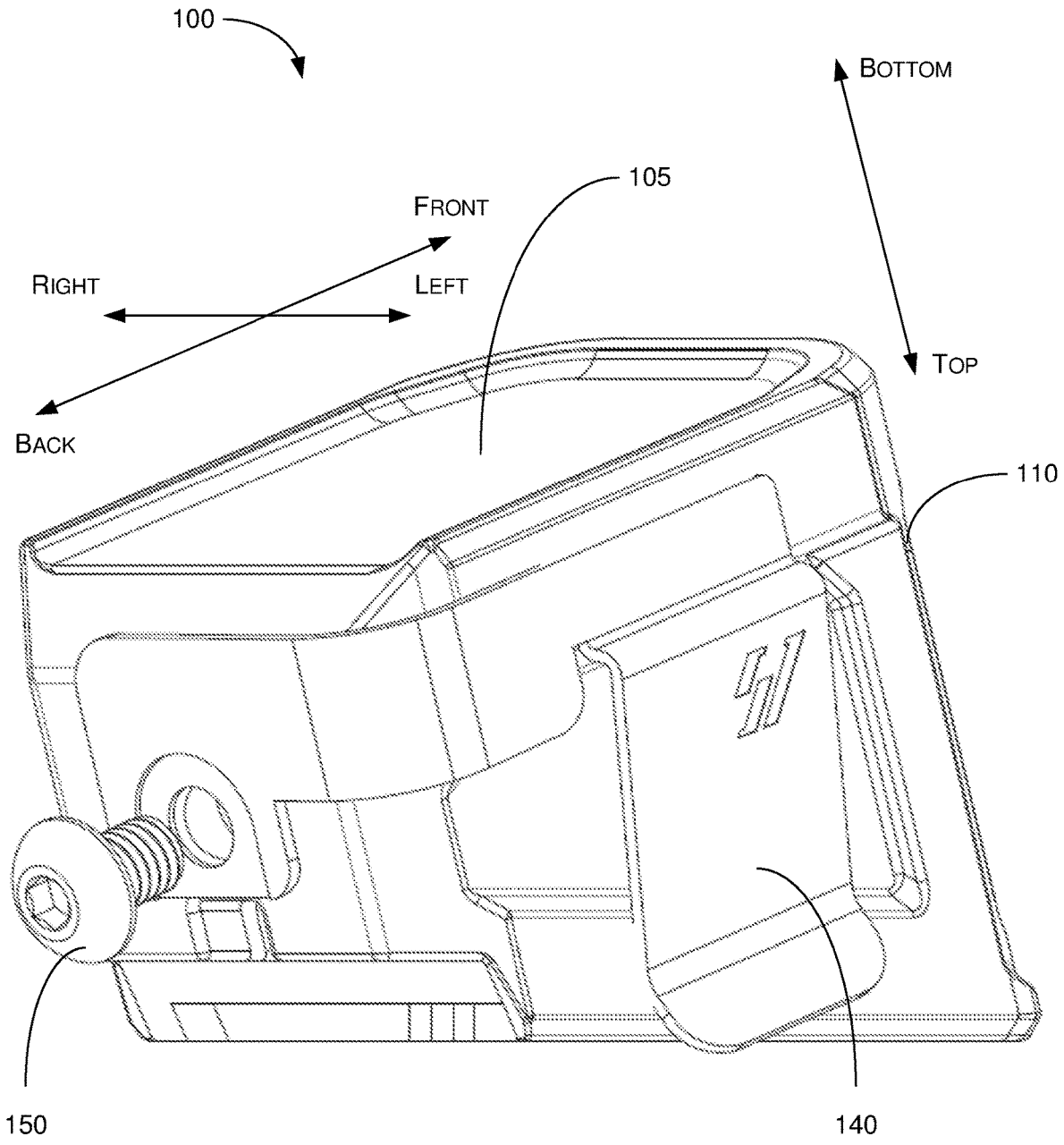
FIG. 4 is a diagram of a first step in assembling components of a firearm magazine pocket clip in accordance with an implementation of the present disclosure.
Figure 5:
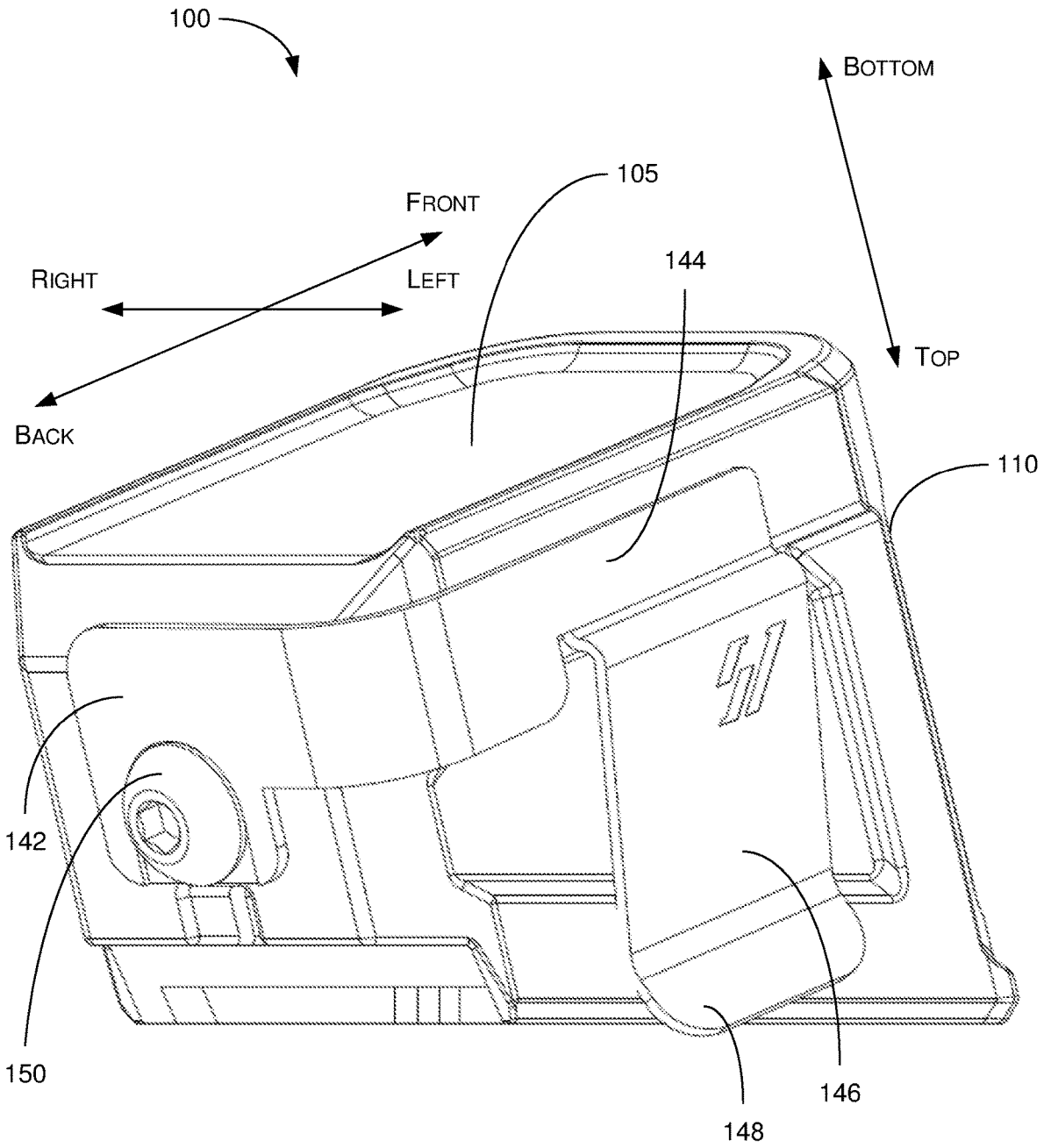
FIG. 5 is a diagram of a second step in assembling components of a firearm magazine pocket clip in accordance with an implementation of the present disclosure.

FIG. 4~FIG. 5 illustrate sequential steps in assembling components of a firearm magazine pocket clip in accordance with an implementation of the present disclosure. Referring to FIG. 4~FIG. 5, magazine extension 100 in accordance with the present disclosure may further include a pocket clip 140 and a securing device 150 (e.g., machine screw or another type of screw) that secures pocket clip 140 to magazine extension housing 110 of magazine extension 100. Pocket clip 140 may be made of steel, aluminum, alloy, ceramics or polymer. In some implementations, magazine extension 100 may include pocket clip 140 and securing device 150 in addition to metal locking plate 120. In such cases, there would be no need for set screw 130 as securing device 150 may be used to secure both metal locking plate 120 and pocket clip 140 to magazine extension housing 110. In other implementations, magazine extension 100 may include pocket clip 140 and securing device 150 without metal locking plate 120.

Under a proposed design in accordance with the present disclosure, pocket clip 140 may be generally L-shaped with a first portion 142 adjacent a first side of magazine extension housing 110 and a second portion 144 adjacent a second side of magazine extension housing 110 when first portion 142 of pocket clip 140 is secured to magazine extension housing 110 by securing device 150. In the example shown in FIG. 4 and FIG. 5, first portion 142 is adjacent the back side of magazine extension housing 110 and second portion 144 is adjacent the left side of magazine extension housing 110 when first portion 142 of pocket clip 140 is secured to magazine extension housing 110 by securing device 150. In alternative designs (not shown), second portion 144 is adjacent the right side of magazine extension housing 110 when first portion 142 of pocket clip 140 is secured to magazine extension housing 110 by securing device 150.

Under a proposed design in accordance with the present disclosure, when pocket clip 140 is secured to magazine extension housing 110, second portion 144 of pocket clip 140 may extend from first portion 142 of pocket clip 140 in a direction parallel to a plane defined by a bottom plate 105 of magazine extension housing 110. Moreover, pocket clip 140 may also include a third portion 146 extending from second portion 144 in a first direction away from bottom plate 105 of magazine extension housing 110. In the example shown in FIG. 4 and FIG. 5, third portion 146 extends toward the top side of magazine extension 100/magazine extension well 110 and away from bottom plate 105.

Under a proposed design in accordance with the present disclosure, pocket clip 140 may further include a fourth portion 148 extending from third portion 146 in a second direction also away from bottom plate 105 of magazine extension housing 110, with the first direction and the second direction being different from each other. In the example shown in FIG. 4 and FIG. 5, fourth portion 148 also extends toward the top side of magazine extension 100/magazine extension well 110 and away from bottom plate 105. For instance, as shown in FIG. 4 and FIG. 5, when pocket clip 140 is secured to magazine extension housing 110, third portion 146 may extend towards magazine extension housing 110 and fourth portion 148 may extend away from magazine extension housing 110.

Under a proposed design in accordance with the present disclosure, securing device 150 may include a machine screw. In such cases, securing device 150, as a machine screw, may be screwed or otherwise inserted into the threaded through hole on magazine extension housing 110 to lock pocket clip 140 (and, optionally, locking plate 120) in place.

Highlight of Features

In view of the above description and FIG. 1~FIG. 5, certain features of a firearm magazine extension are highlighted below.

In one aspect, a device implementable on a firearm (e.g., a pistol, rifle, carbine or shotgun) may include a magazine extension housing, a pocket clip and a securing device. The magazine extension housing may be attachable to a bottom opening of a magazine well of a magazine that is implementable on the firearm. The securing device may be configured to secure the pocket clip to the magazine extension housing.

In some implementations, the pocket clip may be generally L-shaped with a first portion adjacent a first side of the magazine extension housing and a second portion adjacent a second side of the magazine extension housing when the first portion of the pocket clip is secured to the magazine extension housing by the securing device.

In some implementations, when the pocket clip is secured to the magazine extension housing, the second portion of the pocket clip may extend from the first portion of the pocket clip in a direction parallel to a plane defined by a bottom plate of the magazine extension housing. Moreover, the pocket clip may also include a third portion extending from the second portion in a first direction away from the bottom plate of the magazine extension housing.

In some implementations, the pocket clip may further include a fourth portion extending from the third portion in a second direction away from the bottom plate of the magazine extension housing, with the first direction and the second direction being different from each other.

In some implementations, when the pocket clip is secured to the magazine extension housing, the third portion may extend towards the magazine extension housing and the fourth portion may extend away from the magazine extension housing.

In some implementations, the pocket clip may be made of steel, aluminum, alloy, ceramics or polymer.

In some implementations, the device may further include a locking plate receivable in a portion of the magazine extension housing such that the locking plate is configured to lock the magazine extension housing to the magazine well when the magazine extension housing is attached to the magazine well of the magazine.

In some implementations, the locking plate may include a metal locking plate.

In some implementations, the magazine extension housing may be configured with a slot. In such cases, the locking plate may be at least partially inserted in the slot when the locking plate is received in the magazine extension housing.

In some implementations, the locking plate may have a first distal end and a second distal end opposite the first distal end. In such cases, when the locking plate is received in the magazine extension housing, a portion of the locking plate toward the first distal end may be inserted in the slot while another portion of the locking plate toward the second distal end is exposed.

In some implementations, the second distal end of the locking plate may be curved. In such cases, with the second distal end of the locking plate hooking onto a back sidewall of the magazine well when the magazine extension housing is attached to the magazine well, the locking plate may lock the magazine extension housing in place by pressing down onto the back sidewall of the magazine well.

In some implementations, the securing device may include a machine screw. In such cases, the magazine extension housing may be further configured with a threaded through hole through which the machine screw is inserted to lock the pocket clip and the locking plate in place.

In another aspect, a device implementable on a firearm may include a magazine extension housing, a pocket clip, a screw and a locking plate. The magazine extension housing may be attachable to a bottom opening of a magazine well of a magazine that is implementable on the firearm. The screw may be configured to secure the pocket clip to the magazine extension housing. The locking plate may be receivable in a portion of the magazine extension housing such that the locking plate is configured to lock the magazine extension housing to the magazine well when the magazine extension housing is attached to the magazine well of the magazine. Moreover, the magazine extension housing may be configured with a threaded through hole through which the screw is inserted to lock the pocket clip and the locking plate in place.

In some implementations, the pocket clip may be generally L-shaped with a first portion adjacent a first side of the magazine extension housing and a second portion adjacent a second side of the magazine extension housing when the first portion of the pocket clip is secured to the magazine extension housing by the securing device.

In some implementations, when the pocket clip is secured to the magazine extension housing, the second portion of the pocket clip may extend from the first portion of the pocket clip in a direction parallel to a plane defined by a bottom plate of the magazine extension housing. Moreover, the pocket clip may also include a third portion extending from the second portion in a first direction away from the bottom plate of the magazine extension housing.

In some implementations, the pocket clip may further include a fourth portion extending from the third portion in a second direction away from the bottom plate of the magazine extension housing, with the first direction and the second direction being different from each other.

In some implementations, when the pocket clip is secured to the magazine extension housing, the third portion may extend towards the magazine extension housing and the fourth portion may extend away from the magazine extension housing.

In some implementations, the pocket clip may be made of steel, aluminum, alloy, ceramics or polymer.

In some implementations, the magazine extension housing may also be configured with a slot. In such cases, the locking plate may be at least partially inserted in the slot when the locking plate is received in the magazine extension housing. Additionally, the locking plate may have a first distal end and a second distal end opposite the first distal end. Accordingly, when the locking plate is received in the magazine extension housing, a portion of the locking plate toward the first distal end may be inserted in the slot while another portion of the locking plate toward the second distal end is exposed. Moreover, the second distal end of the locking plate may be curved. Furthermore, with the second distal end of the locking plate hooking onto a back sidewall of the magazine well when the magazine extension housing is attached to the magazine well, the locking plate may lock the magazine extension housing in place by pressing down onto the back sidewall of the magazine well.

In some implementations, the device may further include a magazine having a magazine well configured to hold a plurality of rounds of ammunition cartridges. Accordingly, the magazine extension housing may be attachable to a bottom opening of the magazine well of the magazine.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a magazine extension housing attachable to a bottom opening of a magazine body of a magazine that is implementable on the firearm, the magazine extension housing comprising a cavity configured to receive the magazine body when the magazine extension housing is attached to the bottom opening of the magazine body, the magazine extension housing further comprising a rear sidewall having a slot adjacent the cavity and separated from the cavity by at least a portion of the rear sidewall;

a pocket clip;

a screw configured to secure the pocket clip to the magazine extension housing; and a locking plate removably inserted into the slot of the rear sidewall of the magazine extension housing with the locking plate generally extending vertically with respect to the magazine extension housing and with an edge of a flange-shaped hook of the locking plate bent and pointing inwardly toward the magazine body such that the edge of the flange-shaped hook of the locking plate is configured to exert a force on the magazine body to lock the magazine extension housing to the magazine body when the magazine extension housing is attached to the magazine body of the magazine, wherein the magazine extension housing is configured with a threaded through hole through which the screw is inserted to lock the pocket clip and the locking plate in place.

2. The device of claim 1, wherein the pocket clip is generally L-shaped with a first portion adjacent a first side of the magazine extension housing and a second portion adjacent a second side of the magazine extension housing when the first portion of the pocket clip is secured to the magazine extension housing by the screw.

3. The device of claim 2, wherein, when the pocket clip is secured to the magazine extension housing, the second portion of the pocket clip extends from the first portion of the pocket clip in a direction parallel to a plane defined by a bottom plate of the magazine extension housing, and wherein the pocket clip further comprises a third portion extending from the second portion in a first direction away from the bottom plate of the magazine extension housing.

4. The device of claim 3, wherein the pocket clip further comprises a fourth portion extending from the third portion in a second direction away from the bottom plate of the magazine extension housing, and wherein the first direction and the second direction are different.

5. The device of claim 4, wherein, when the pocket clip is secured to the magazine extension housing, the third portion extends towards the magazine extension housing and the fourth portion extends away from the magazine extension housing.

6. The device of claim 1, wherein the pocket clip is made of steel, aluminum, alloy, ceramics or polymer.

7. The device of claim 1, wherein the magazine extension housing is further configured with a slot, wherein the locking plate is at least partially inserted in the slot when the locking plate is received in the magazine extension housing, wherein the locking plate has a first distal end and a second distal end opposite the first distal end, wherein, when the locking plate is received in the magazine extension housing, a portion of the locking plate toward the first distal end is inserted in the slot while another portion of the locking plate toward the second distal end is exposed, wherein the second distal end of the locking plate is curved to form the hook, and wherein, with the second distal end of the locking plate hooking onto a back sidewall of the magazine body when the magazine extension housing is attached to the magazine body, the locking plate locks the magazine extension housing in place by pressing down onto the back sidewall of the magazine body with the hook.

8. The device of claim 1, further comprising:

the magazine comprising the magazine body configured to hold a plurality of rounds of ammunition cartridges, wherein the bottom opening of the magazine body is received in the cavity when the magazine extension housing is attachable to the magazine.

* * * * *